US006237790B1

(12) United States Patent
Verderber

(10) Patent No.: US 6,237,790 B1
(45) Date of Patent: May 29, 2001

(54) CAP HAVING DE-OVALIZATION BEAD ON SKIRT

(75) Inventor: Rudolph R. Verderber, San Jose, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 09/198,436

(22) Filed: Nov. 24, 1998

(51) Int. Cl.[7] ..... B65D 39/00

(52) U.S. Cl. ..... 215/254; 215/317; 220/780; 220/782

(58) Field of Search ..... 215/254, 317, 215/318; 220/780, 782, 284

(56) References Cited

U.S. PATENT DOCUMENTS

| | | | | |
|---|---|---|---|---|
| 2,789,607 | * | 4/1957 | Tupper | 220/780 |
| 3,262,600 | * | 7/1966 | Gach | 220/284 |
| 3,334,769 | * | 8/1967 | Gach | 220/284 |
| 3,515,307 | * | 6/1970 | Gach | 220/284 X |
| 3,531,013 | * | 9/1970 | Hammes | 220/782 |
| 3,532,249 | * | 10/1970 | Gach | 220/284 |
| 3,739,976 | * | 6/1973 | MacDaniel | 220/780 |
| 4,166,548 | * | 9/1979 | Crisci | 220/780 X |
| 4,380,304 | * | 4/1983 | Anderson | 220/306 |
| 5,540,349 | * | 7/1996 | Philips | 220/306 |
| 5,662,231 | * | 9/1997 | Adams et al. | 215/254 |
| 5,687,865 | | 11/1997 | Adams et al. | 215/253 |
| 5,911,334 | * | 6/1999 | Helms | 220/780 X |

* cited by examiner

*Primary Examiner*—Stephen K. Cronin
(74) *Attorney, Agent, or Firm*—Flehr Hohbach Test Albritton & Herbert LLP

(57) ABSTRACT

A bottle cap (10) having a top panel (12) with an inner skirt (16) and an outer skirt (14) having an exterior bead (24) at the bottom edge thereof. Exterior bead (24) includes an inward projection as well. Outer skirt (14) has a reduced thickness in order to reduce the mass of the cap and exterior bead (24) provides sufficient de-ovalization support to keep skirt 14 cylindrical in shape.

16 Claims, 2 Drawing Sheets

CAP HAVING DE-OVALIZATION BEAD ON SKIRT

TECHNICAL FIELD

The present invention relates to caps for bottles and similar types of containers and, more particularly, to caps for plastic water and juice containers and an improved design of the skirt portion of the cap.

BACKGROUND ART

Ovalization of a plastic bottle cap, particularly caps for five-gallon water bottles and the like, is a problem typically caused by packing of too many caps for a particular package design. The caps press down on caps below and cause a slight ovalization of the skirt. Equipment used to mount the cap onto the neck of a water bottle after the bottle is filled with water has difficulty doing so when the skirt of the cap becomes ovalized and, thus, does not match the round shape of the bottle neck.

Some currently used bottle caps are designed with constant thickness skirt dimensions, which provides added rigidity to the skirt and relies primarily on hoop stress to prevent ovalization, but also adds to the weight of the skirt. A large quantity of such caps packed together creates enough added weight to overcome the rigidity of thicker skirts and cause ovalization.

U.S. Pat. No. 5,687,865 of Adams et al. discloses a spill-reduction cap for fluid containers, which cap has a downwardly depending skirt with an interior bead at the bottom edge of the skirt for engaging a bottle neck to prevent dirt from entering under the skirt. One disadvantage of an interior bead is that it results in an undesirable undercut increasing the difficulty of ejecting the cap during a mold ejection process. While the internal bead does add mass to the skirt and may have a de-ovalization effect, the cap of the present invention achieves several advantages over the cap of Adams et al. that are discussed herein.

DISCLOSURE OF INVENTION

Briefly described, the improved bottle cap of the present invention includes a top panel for covering the neck opening of a bottle and a skirt depending downwardly from the top panel. The skirt includes an exterior bead adjacent the lower peripheral edge of the skirt, with the exterior bead projecting radially outwardly from the skirt. Preferably, the skirt is substantially cylindrical in shape in its lower region and the interior surface of the skirt opposite the exterior bead also has an inward projection.

An advantage of an external bead is that it provides more surface area for a stripper ring mechanism during ejection of the cap from injection mold components. Reference is made to my co-pending application Ser. No. 09/172,721, entitled "Apparatus and Method of Forming Cap," for a more detailed explanation of this advantage of the present invention.

According to an aspect of the invention, the inward projection is angled and has a downwardly, inward taper. According to another aspect of the invention, the skirt has a reduced thickness side wall dimension. The overall weight reduction of the cap, in combination with the exterior bead design at the bottom of the skirt, provides a cap with sufficient resistance to ovalization when a multiplicity of caps are packed into a box for shipment.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
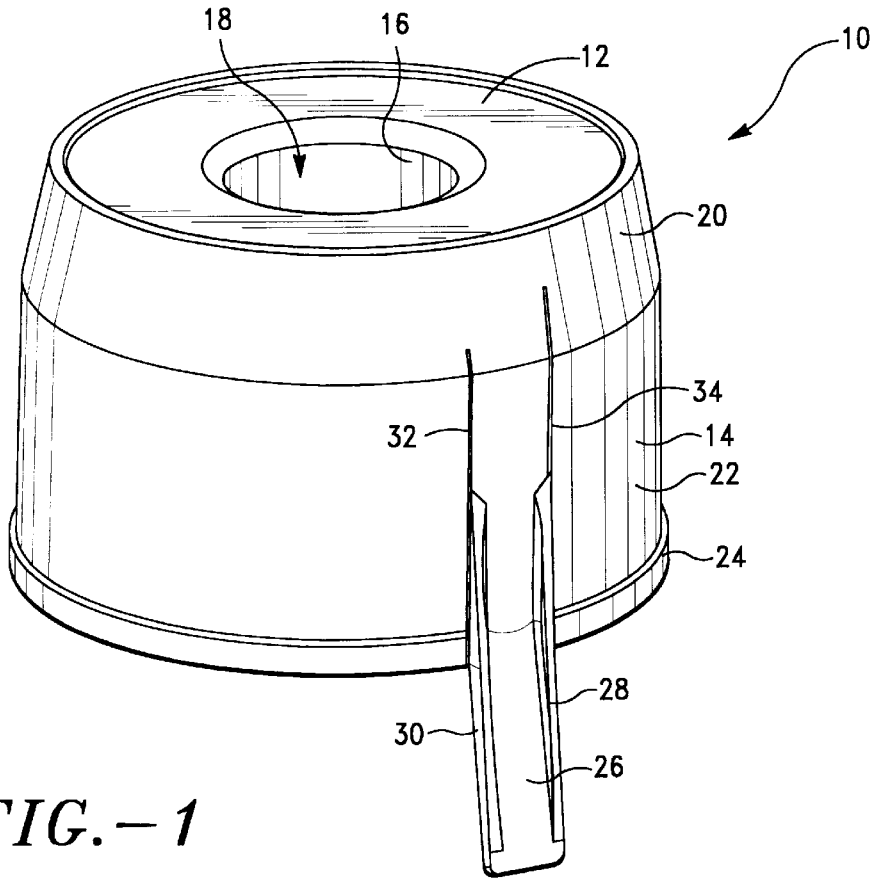
FIG. 1 is a pictorial view of the bottle cap of the present invention.

Referring to FIG. 1, the bottle cap 10 of the present invention includes an annular top panel 12 and a cylindrical downwardly depending outer skirt 14. Bottle cap 10 is illustrated as a non-spill cap including a concentric inner skirt 16 forming an opening 18 at the center of the cap. Opening 18 is provided to receive a probe or feed tube of a dispensing unit in a manner that dislodges a plug that is removably mounted at the bottom of inner skirt 16. Non-spill caps and their basic design and operation are well known in the art. However, the present invention is not meant to be limited to non-spill caps and, in fact, the present invention works quite well with any type of generally cylindrical cap, including conventional tear-away caps.

Outer skirt 14 includes an inwardly angled upper portion 20 and a more upright, generally cylindrical lower portion 22. Angled upper portion 20 is the subject of a co-pending application filed concurrently with this application, and entitled "Cap Structure with Angled Upper Skirt," Ser. No. 09/186,406. Lower skirt portion 22 is provided as a protective cover for sanitary reasons to prevent dirt and debris from accumulating on the neck region of the bottle.

At the bottom edge of lower skirt 22 is provided an annular exterior bead 24 that extends around the lower peripheral edge of skirt 14. As discussed in more detail later, annular bead 24 provides stiffness or rigidity at the lower portion of skirt 14 in order to prevent ovalization.

Cap 10 also includes a downwardly extending pull tab 26. Pull tab 26 has an outward cant and includes a pair of side strengthening ribs 28, 30, which assists in mounting of cap 10 onto the neck of a water bottle, for example. Also, a pair of reduced thickness tear lines 32, 34 are provided. Tear line 34 extends farther up into angled skirt portion 20 than does tear line 32. Tab 26 is provided in order to remove cap 10, either to mount the bottle onto a conventional dispenser that does not include a non-spill feature or to refill the bottle after the contents of the bottle have been dispensed.

Figure 2:
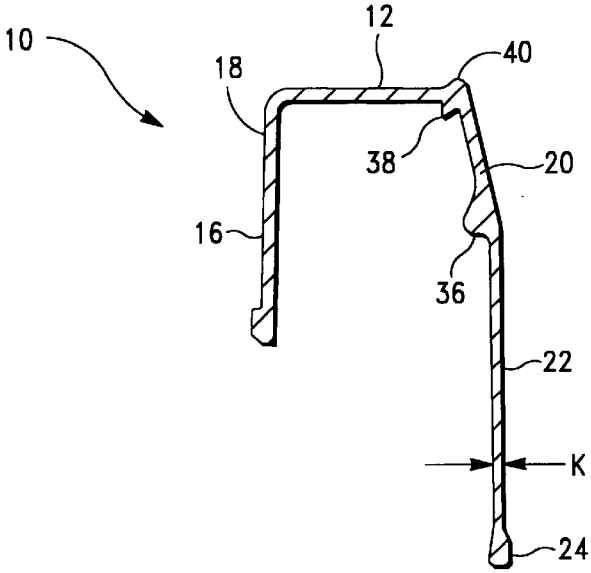
FIG. 2 is a sectional view of one half of the bottle cap of FIG. 1.

Referring to FIG. 2, a sectional portion of cap 10 is shown to include an inwardly projecting locking bead 36 that is the subject of co-pending patent application Ser. No. 09/169,220, entitled "Internal Cap Bead Structure." Locking bead 36 extends around the interior wall of cap 10 at the junction of angled upper skirt portion 20 and cylindrical lower skirt portion 22. Cap 10 also includes an inner downwardly projecting seal bead 38 that functions to seat against the upper rim of a bottle neck to seal the opening of the bottle neck. Locking bead 36 functions to seat around the underside of the upper crown of the bottle neck in order to hold the cap on the bottle and to bias seal bead 38 down onto the bottle's rim. Cap 10 further includes an upper perimeter label bead 40 that defines an area for applying a stick-on label over opening 18 and also provides an application point for an applicator to push cap 10 onto a bottle neck. This feature is discussed in more detail in co-pending patent application Ser. No.09/186,406, entitled "Cap Structure with Angled Upper Skirt."

Figure 3:
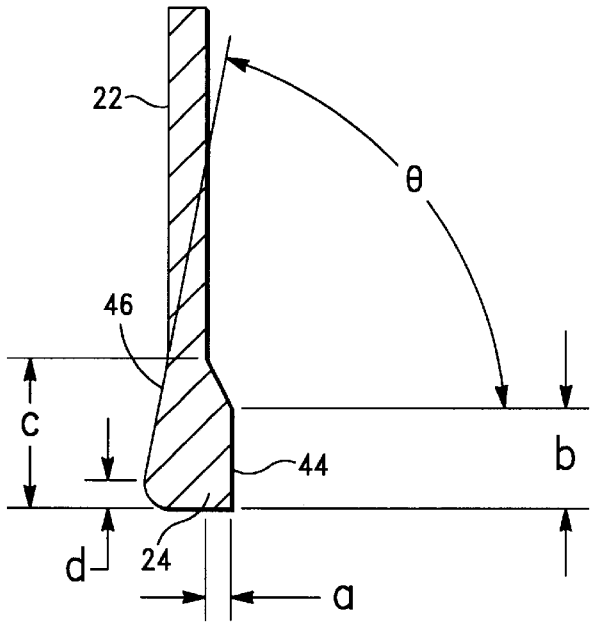
FIG. 3 is an enlarged sectional view of the exterior bead at the bottom edge of the outer skirt.

Referring to FIG. 3, lower skirt portion 22 and exterior bead 24 are shown in an enlarged section view. Exterior bead 24 includes a blunt, outward projection 44 and a downwardly angled or tapered inward projection 46. The angle formed by inward projection is preferably about 80 degrees, as shown by angle θ, but can form other angles and have different shapes according to the invention.

The cap 10 shown in the figures and discussed herein is a cap for a five-gallon water bottle, but the present invention is not meant to be limited to any particular size cap or any particular size bottle. However, as an example of a preferred embodiment of the present invention, the following dimensions are provided for a five-gallon cap of the present invention. Referring to FIG. 3, outward projection 44 has a projection of 0.02 inches, as shown by reference letter a, and a height of 0.08 inches, as shown by reference letter b. Inward projection 46 has a height of 0.10 inches, as shown by reference letter c, with a straight, vertical bottom section having a height of 0.03 inches, as shown by reference letter d.

Figure 4:
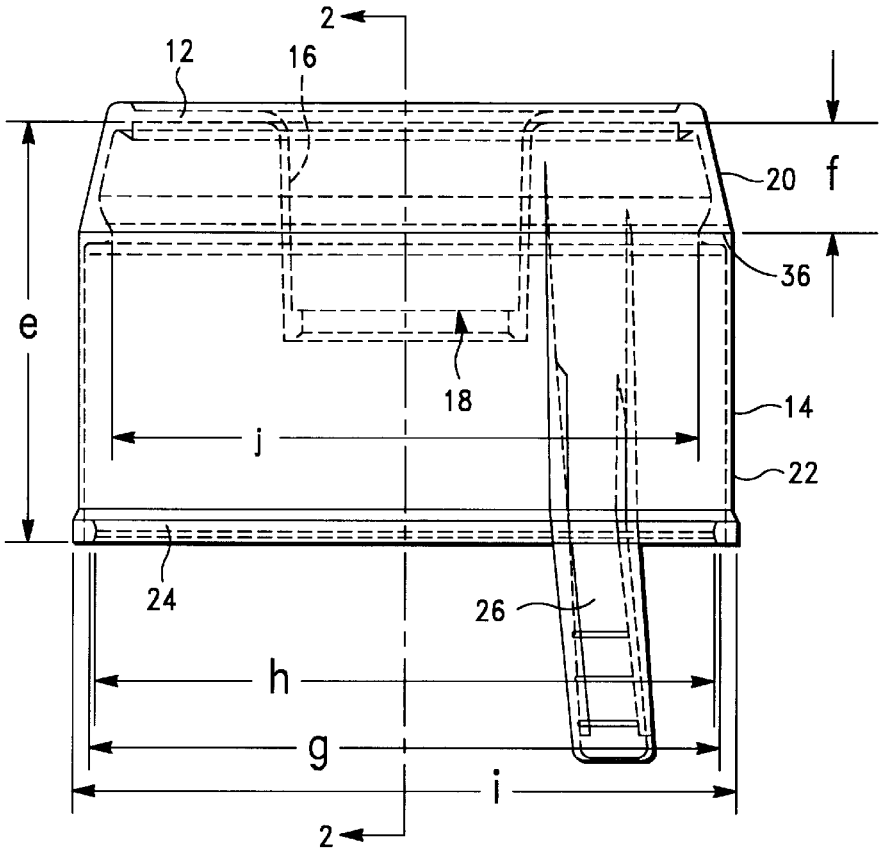
FIG. 4 is a sectional view of the cap of FIG. 1.

Referring to FIG. 4, the height of cap 10, from exterior bead 24 to top panel 12 is 1.41 inches, as shown by reference letter e, and the height of angled upper skirt portion 20 is 0.37 inches, as shown by reference letter f. The inner diameter of skirt 14 is 2.17 inches, as shown by reference letter g, and the inner diameter of exterior bead 24 is 2.14 inches, as shown by reference letter h. The outer diameter of skirt 14 at its lower edge is 2.22 inches, as shown by reference letter i. The inside diameter of locking bead 36 is 2.01 inches, as shown by reference letter j.

Preferably, the thickness of skirt 14 is 0.03 inches, as shown by reference letter k. The provision of a lower exterior bead 24 around the bottom of skirt 14 allows for a substantially thinner skirt than provided on conventional five-gallon caps with constant thickness skirts due to the de-ovalization effect achieved by bead 24 and also due to the overall lighter weight of cap 10 due to its reduced dimensions as shown herein.

As discussed previously, ovalization of plastic bottle caps, particularly caps for five-gallon water bottles, is a problem when large quantities of caps are packed in boxes for shipment. The upper caps press down on caps below, deforming and causing a slight ovalization of the skirt. Equipment used to mount the caps onto the neck of water bottles after the bottles are filled with water has difficulty doing so when the skirts of the caps becomes ovalized and, thus, does not match the round shape of the bottle neck. For this reason, equipment is installed to reject caps with ovalized skirts prior to mounting of the caps on bottles. While some currently used bottle caps are designed with thicker skirt dimensions, which provides added rigidity to the skirt to prevent ovalization, the added weight of the skirt tends to overcome the skirt's rigidity and cause ovalization. As a result, prior art solutions to ovalization have not been entirely satisfactory. The present invention provides a cap design that substantially avoids ovalization due to the improved design of the skirt region and due to the overall lower weight of the cap achieved thereby.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

The invention claimed is:

1. A cap for closing a round container neck opening, the cap comprising, a top for covering the neck opening, a skirt depending downwardly from the top, the skirt including a cylindrical portion having a lower peripheral edge, a rigidity bead adjacent the lower peripheral edge for preventing ovalization, the rigidity bead projecting radially from the skirt a radial distance dimensioned to prevent a person from engaging a bottom of the rigidity bead to leverage the cap up off the container neck, an inward projection located on an interior surface of the cylindrical portion, the inward projection positioned directly opposite the rigidity bead, the inward projection being downwardly angled and inwardly tapered, and a locking bead positioned on an interior surface of the skirt intermediate the top and the rigidity bead for holding the cap on the container, the locking bead projecting radially inwardly from the skirt, wherein the skirt has a thickness dimension which allows ovalization, and wherein the rigidity bead and the inward projection are dimensioned to inhibit ovalization of the skirt.

2. The cap of claim 1 wherein, the skirt has a thickness of approximately 0.03 inches.

3. The cap of claim 1 wherein, the rigidity bead and the inward projection are positioned at a bottom edge of the skirt.

4. The cap of claim 1 wherein, the cylindrical portion of the skirt has a height that is at least one-third the diameter of the cap.

5. The cap of claim 1 wherein, the cylindrical portion of the skirt has a height that is at least one-half the diameter of the cap.

6. The cap of claim 1 wherein, the upper portion of the skirt has an inwardly angled slope.

7. The cap of claim 6 wherein, the upper portion of the skirt has a frustoconical shape.

8. The cap of claim 1 wherein, the skirt has a thickness of approximately 0.03 inches so that the combined thickness of the skirt and the rigidity bead is no greater than approximately 0.05 inches.

9. The cap of claim 8 wherein, the rigidity bead is adjacent a bottom edge of the skirt.

10. The cap of claim 1 wherein, the rigidity bead has a height dimension that is at least three times as great as the radial distance of the rigidity bead.

11. The cap of claim 10 wherein, the rigidity bead has a height dimension that is at least four times as great as the radial distance of the rigidity bead.

12. The cap of claim 1 wherein, said radial distance of the rigidity bead is no greater than approximately 0.02 inches.

13. The cap of claim 12 wherein, the skirt has a thickness of approximately 0.03 inches so that the combined thickness of the skirt and the rigidity bead is no greater tan approximately 0.05 inches.

14. The cap of claim 1 wherein, the cylindrical portion of the skirt has a height that is at least one-quarter the diameter of the cap.

15. The cap of claim 14 wherein, the cylindrical skirt has a height of approximately 1.04 inches.

16. The cap of claim 15 wherein, the skirt has a thickness that is dimensioned to allow ovalization the rigidity bead is dimensioned to inhibit ovalization.

* * * * *